US007356297B2

(12) United States Patent
Montfort et al.

(10) Patent No.: US 7,356,297 B2
(45) Date of Patent: Apr. 8, 2008

(54) CURVED TRANSFER ASSIST BLADE

(75) Inventors: David Montfort, Webster, NY (US); Eliud Robles-Flores, Webster, NY (US); John R. Falvo, Ontario, NY (US); Edward W. Schnepf, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/363,784

(22) Filed: Feb. 28, 2006

(65) Prior Publication Data

US 2007/0201912 A1 Aug. 30, 2007

(51) Int. Cl.
*G03G 15/16* (2006.01)

(52) U.S. Cl. ..... 399/316; 399/121; 399/388

(58) Field of Classification Search ..... 399/316, 399/121, 311, 312, 314, 317, 388, 310, 313
See application file for complete search history.

(56) References Cited

U.S. PATENT DOCUMENTS 6,134,398 A 10/2000 Grace
7,092,663 B2 * 8/2006 Takahashi et al. ..... 399/316
2003/0039488 A1 2/2003 Fayette et al.
2003/0039490 A1 * 2/2003 Obrien et al. ..... 399/316
2003/0108369 A1 6/2003 Kuo et al.
2007/0104519 A1 * 5/2007 Soures et al. ..... 399/316

* cited by examiner

*Primary Examiner*—David M. Gray
*Assistant Examiner*—Joseph S. Wong
(74) *Attorney, Agent, or Firm*—Gibb & Rahman, LLC

(57) ABSTRACT

Embodiments herein include a transfer assist blade that is adapted to bias media toward a marking device. The transfer assist blade is somewhat flexible and has a media contact edge positioned adjacent the marking device. The shape of the media contact edge comprises a curved shape. More specifically, the transfer assist blade assembly comprises a base and a transfer assist blade operatively connected to (or made an integral part of) the base. The curved media contact edge of the transfer assist blade comprises a center portion and end portions distal to the center portion, and the center portion extends a different distance from the base than the end portions extend from the base. Thus, the shape of the media contact edge can comprise one of a convex shape, a concave shape, and an irregular shape.

10 Claims, 7 Drawing Sheets

CURVED TRANSFER ASSIST BLADE

BACKGROUND

Embodiments herein generally relate to electrostatographic printers and copiers or reproduction machines, and more particularly, concerns a transfer assist blade assembly for contacting an image receiving sheet.

The process of transferring charged toner particles from an image bearing member (e.g. photoreceptor) to an image support substrate (e.g. copy sheet) is enabled by overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. One aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing of the developer material.

Alternatively, mechanical devices that force the image support substrate into intimate and substantially uniform contact with the image bearing surface have been incorporated into transfer systems. Various contact blade arrangements have been proposed for sweeping the backside of the image support substrate, with a constant force, at the entrance to the transfer region. However, deletions may occur using these methods, especially in duplex.

In some conventional transfer assist blade assemblies each segmented blade is actuated by a separate solenoid. In other conventional transfer assist blade assemblies as disclosed for example in U.S. Pat. No. 6,134,398, the complete disclosure of which is incorporated herein by reference, the engagement timing and the width adjustment of the segmented blades are under separate mechanical controls, and the blade width adjustment is separately controlled by a rack and pinion mechanism.

SUMMARY

Embodiments herein include a transfer assist blade adapted to bias media toward a marking device. The transfer assist blade can be somewhat flexible and has a media contact edge positioned adjacent the marking device. The shape of the media contact edge comprises a curved shape. More specifically, the transfer assist blade assembly comprises a base and a transfer assist blade operatively connected to (or made an integral part of) the base. The curved media contact edge of the transfer assist blade comprises a center portion and end portions distal to the center portion, and the center portion extends a different distance from the base than the end portions extend from the base. Thus, the shape of the media contact edge can comprise one of a convex shape, a concave shape, and an irregular shape.

A printing apparatus embodiment comprises a marking device and the aforementioned transfer assist blade positioned adjacent the marking device. For example, the marking device can comprise an electrostatographic device, xerographic device, etc. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 9:
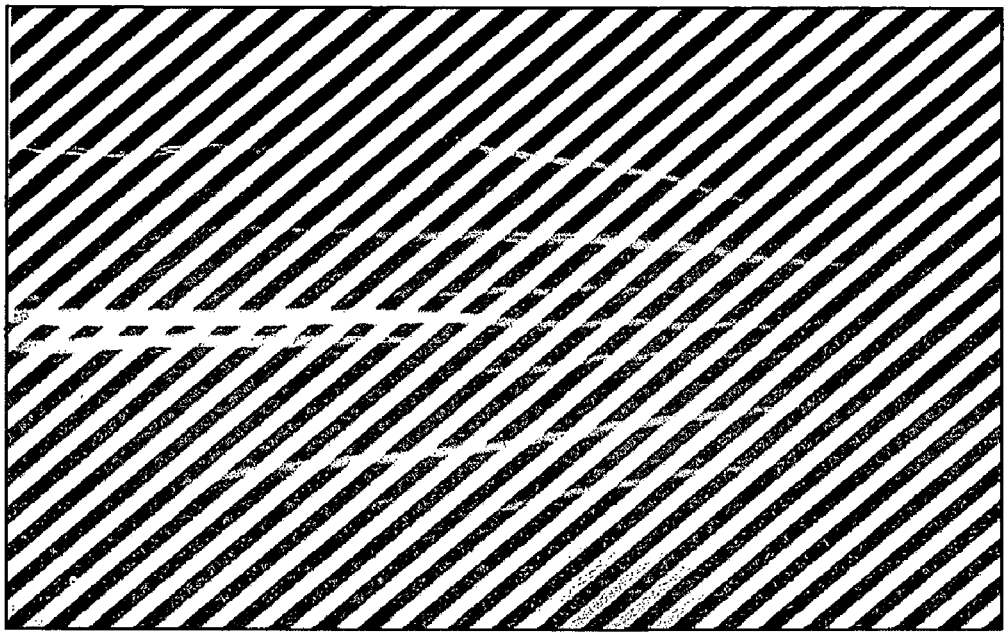
FIG. 9 is a schematic diagram of transfer deletions that occur in "finger-like" patterns.

The embodiments herein are useful with printing/copying devices that use transfer assist blades, such as those discussed in U.S. Patent Application 2003/0108369, the complete disclosure of which is incorporated herein by reference, and portions of which are incorporated herein. One problem with systems that use transfer assist blades is that transfer deletions can occur in "finger-like" patterns (FIG. 9), and this typically occurs on high humidity, lightweight paper. The present inventors discovered that such deletions are formed due to media buckle/ripple which creates gaps in the transfer zone. The media buckle/ripple is highly influenced by moisture content in the paper. Since highly specific media acclimation procedures (e.g., low humidity sheds, etc.) are not a practical solution, embodiments herein utilize a curved transfer assist blade assembly (see the discussion of FIGS. 1-4 below) to provide significant solution to the finger-like transfer deletions. The curved transfer assist blade assembly discussed below is successful in eliminating deletions on even lightweight paper at very high humidity and temperature conditions that would result in a highly rippled state of the media.

Figure 10:
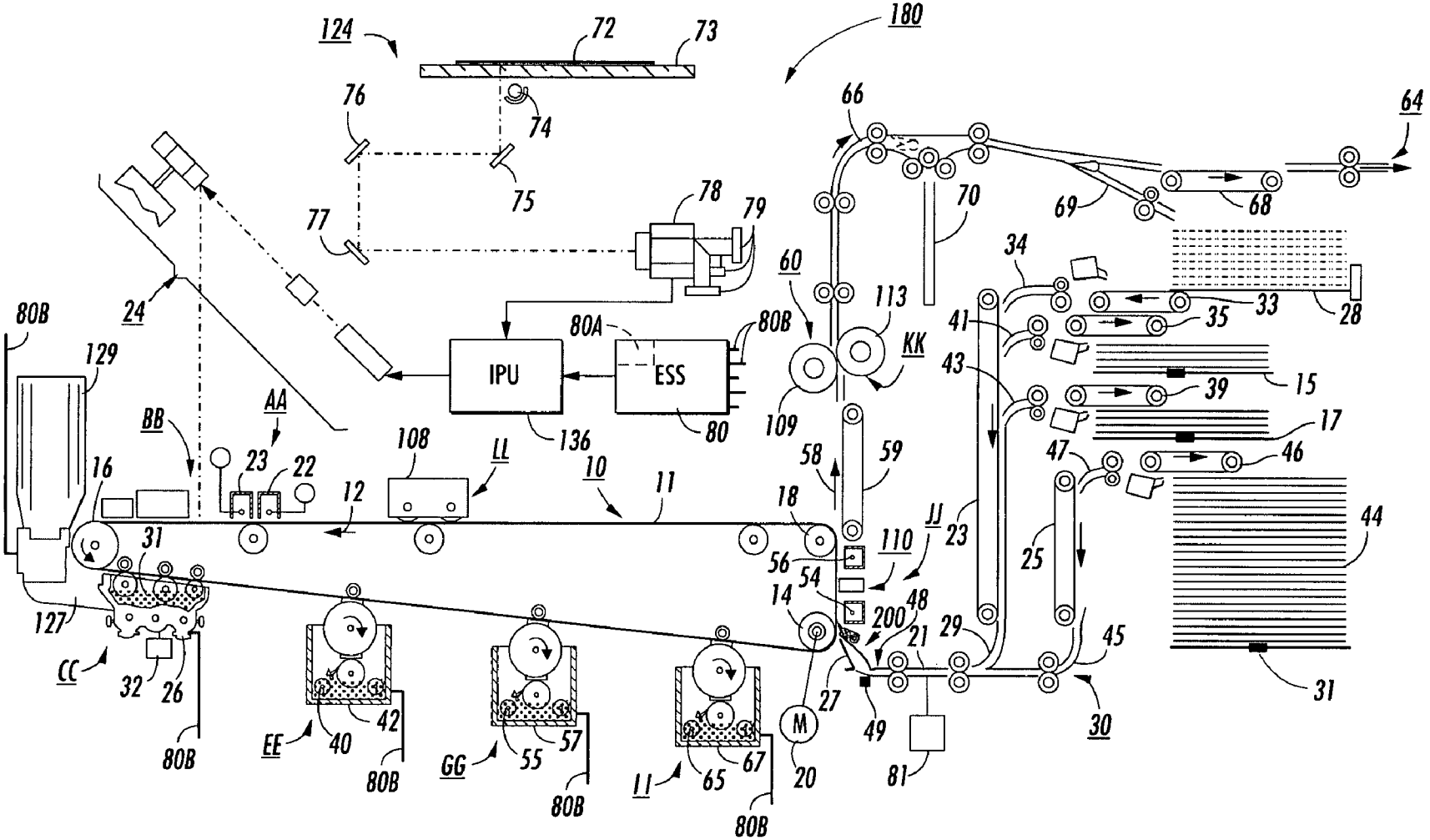
FIG. 10 is a schematic diagram of a printing device.

Referring first to FIG. 10, there is depicted an exemplary electrostatographic reproduction machine, for example, a multipass color electrostatographic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the sequential transfer assist blade assembly 200 (FIG. 11) (to be described in detail below).

The ESS is preferably a self-contained, dedicated mini-computer having a central processor unit (CPU), electronic storage, and a display or user interface (UI). The ESS is the control system which, with the help of sensors, and connections 80B as well as a pixel counter 80A, reads, captures, prepares and manages the image data flow between IPU 136 and image input terminal 124. In addition, the ESS 80 is the main multi-tasking processor for operating and controlling all of the other machine subsystems and printing operations. These printing operations include imaging, development, sheet delivery and transfer, and particularly control of the sequential transfer assist blade assembly. Such operations also include various functions associated with subsequent finishing processes. Some or all of these subsystems may have micro-controllers that communicate with the ESS 80.

The multipass color electrostatographic reproduction machine 180 employs a photoreceptor 10 in the form of a belt having a photoconductive surface layer 11 on an electroconductive substrate. The surface 11 can be made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separatism image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member 50 negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units thus have their development functions turned off.

During the exposure and development of the last color separation image, for example by the fourth development unit 65, 67 a sheet SS of support material is advanced to a transfer station JJ by a sheet feeding apparatus 30. During simplex operation (single sided copy), a blank sheet SS may be fed from tray 15 or tray 17, or a high capacity tray 44 could thereunder, to a registration transport 21, in communication with controller 81, where the sheet is registered in the process and lateral directions, and for skew position. As shown, the tray 44 and each of the other sheet supply sources includes a sheet size sensor 31 that is connected to the controller 80. One skilled in the art will realize that trays 15, 17, and 44 each hold a different sheet type.

The speed of the sheet SS is adjusted at registration transport 21 so that the sheet arrives at transfer station JJ in synchronization with the composite multicolor image on the surface of photoconductive belt 10. Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet SS from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets SS from tray 44 to transport 25 by a chute 47.

As shown, pretransfer baffles 27 guide the sheet SS from the registration transport 21 to transfer station JJ. Charge limiter 49 located on pretransfer baffles 27 restricts the amount of electrostatic charge a sheet can place on the baffles 27 thereby reducing image quality problems and shock hazards. The charge can be placed on the baffles from either the movement of the sheet through the baffles or by the corona generating devices 54, 56 located at transfer station JJ. When the charge exceeds a threshold limit, charge limiter 49 discharges the excess to ground.

Transfer station JJ includes a transfer corona device 54 which provides positive ions to the backside of the copy sheet SS. This attracts the negatively charged toner powder images from photoreceptor belt 10 to the sheet SS. A detack corona device 56 is provided for facilitating stripping of the sheet SS from belt 10. A sheet-to-image registration detector 110 is located in the gap between the transfer and corona devices 54 and 56 to sense variations in actual sheet to image registration and provides signals indicative thereof to ESS 80 and controller 81 while the sheet SS is still tacked to photoreceptor belt 10.

The transfer station JJ also includes the transfer assist blade assembly 200, (to be described in detail below) in which various segmented blades are engaged for contacting the backside of the image receiving sheet SS. After transfer, the sheet SS continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed for example at cleaning station LL using a cleaning brush structure contained in a unit 108.

Figure 11:
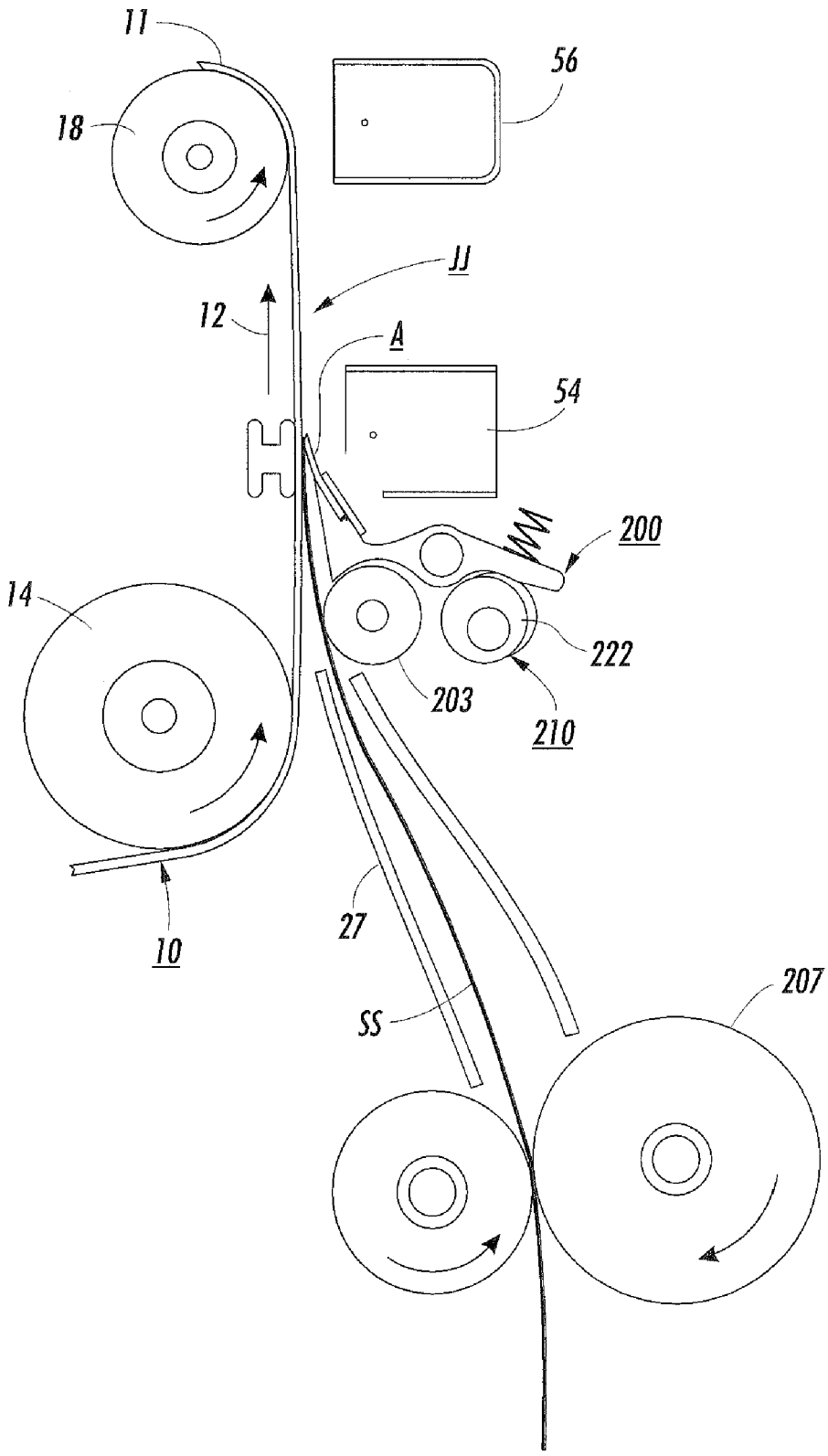
FIG. 11 PRIOR ART
FIG. 11 is a schematic diagram of a transfer blade assist assembly.
Figure 12:
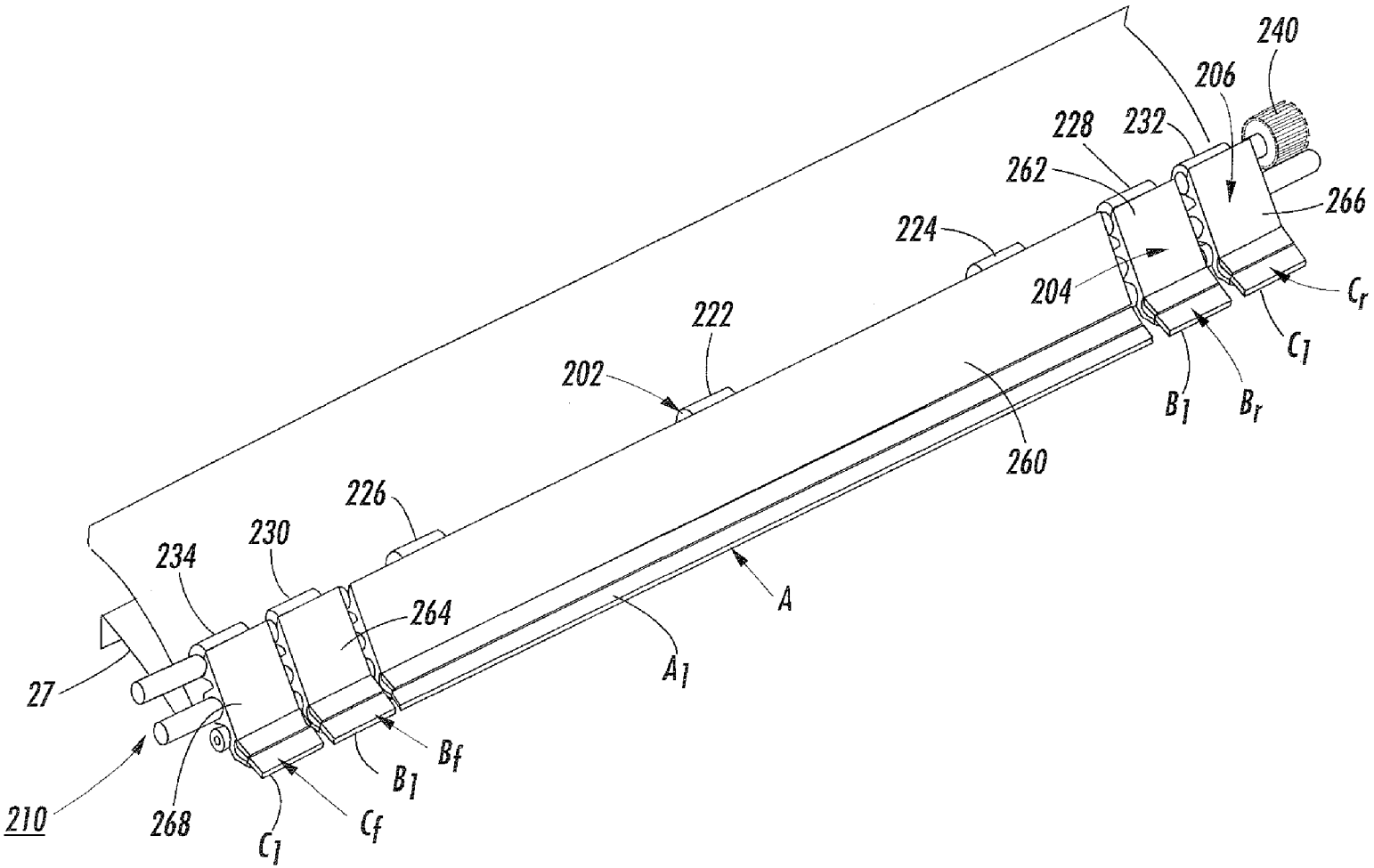
FIG. 12 PRIOR ART
FIG. 12 is a schematic diagram of a transfer assist blade.

Referring now to FIGS. 11 and 12, the transfer assist blade assembly 200 as variously illustrated includes a first cam and blade assembly 202 that comprises a first blade segment A having a first length (A1) and being movable for first contacting a first size image receiving sheet SS. The sequential transfer assist blade assembly 200 includes baffles 27, an idle roll 203, the cam shaft assembly 210, and the segmented blades A, Bf, Br, Cf, Cr. Also shown are (i) registration rolls 207 for providing input sheets SS to the transfer station JJ and (ii) corotron devices 54, 56 for applying electrostatic charge to sheets SS at the transfer station JJ. It also comprises a second cam and blade assembly 204 including a second blade segment Bf and a third blade segment Br each having a second length (B1), and each being located adjacent a first end and a second end respectively of the first blade segment A as shown.

FIG. 12 shows alignment of the cams against their corresponding blade segments A, Bf, Br, and Cf, Cr. For a center-registration system, for example, each of the first or middle three cams 222, 224, 226 (for the segment A blade) includes a significantly long cam lobe having a constant radius for dwell, and together are arranged for engaging and contacting the middle blade (segment A blade) which is the narrowest of the three sheet widths. Each of the next two, or the second and third cams 228, 230 (for the segment Bf, Br blades) includes a reduced length cam lobe that has a constant radius for dwell, and as shown, they are located on opposite sides of the first or middle cams 222, 224, 226. As such, they correspond to, and are suitable for engaging the two segment Bf, Br blades on either side of the central segment A blade. Together with the first or middle cams 222, 224, 226, these second and third cams 228, 230 are sufficient for engaging and contacting the middle blade (segment A blade) and the segment Bf, Br blades which correspond to the next size sheet width. Similarly, the outer most or the fourth and fifth cams 232, 234 include the narrowest cam lobe that has a constant radius for dwell, and are placed for engaging the outer most blades (Cf, Cr blades) for the widest sheet width. The sequential transfer assist blade assembly 200 further comprises a third cam and blade assembly 206 including a fourth blade segment Cf and a fifth blade segment Cr each having a third length (C1), and each being located adjacent the second blade segment and the third blade segment respectively. The sequential transfer-assist blade assembly 200, in addition to the cam shaft assembly 210, further comprises plural blade support levers including first 260, second 262, third 264, fourth 266 and fifth 268 blade support levers, each of which is pivotable. The cam shaft assembly 210 also includes a drive means in the form of a stepper motor 240 for rotatably moving the rotatable cam shaft. While FIG. 12 illustrates a segmented transfer assist blade, the embodiments herein are equally applicable to a non-segmented transfer assist blade that comprises only the center section 260.

Figure 1:
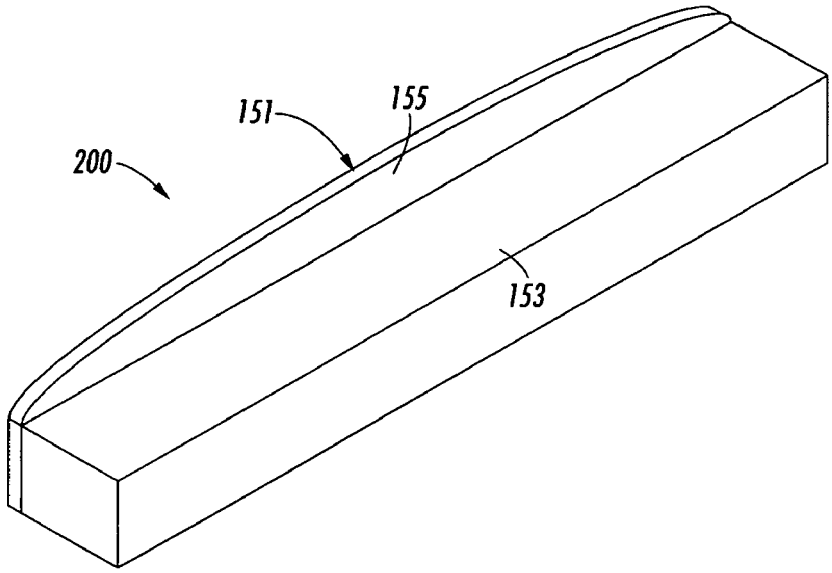
FIG. 1 is a schematic diagram of a curved transfer assist blade.

Referring now to FIG. 1, in embodiments herein the transfer assist blade assembly 200 includes a transfer assist blade 155 that is adapted to bias the media SS toward the marking device 11. The transfer assist blade 155 is somewhat flexible and has a media contact edge 151 positioned adjacent the marking device 11. The shape of the media contact edge 151 comprises a curved shape. The shape can be chosen to create a force vectoring profile that will squeeze the ripple out from the center to the edges or from edge-to-edge.

The curved shape flattens out lightweight rippled paper just prior to the transfer process, thereby eliminating the above-mentioned transfer deletions. The curved edge of the curved transfer assist blade is superior to the linear transfer assist blade in removing ripples from paper because of the way the curved edge applies pressure to the media sheet as it moves down the length of media sheet (e.g., moves down linear regions of the media sheet, from the top to the bottom of the media sheet). More specifically, as the media sheet moves past the curved transfer assist blade, the curved edge applies pressure to the center of the media sheet and to outer portions of the media sheet at different linear locations along the length (from top to bottom or bottom to top) of the media sheet. Therefore, when pressure is applied by the center of the curved edge to a ripple or bubble that occurs in the center of the media sheet, the adjacent linear outer regions of the media sheet are free to move, which allows the ripple to flatten out. Similarly, when pressure is applied to the outer portions of the media sheet by the outer portions of the curved transfer assist blade edge, the center section of an adjacent linear region of the media sheet is free to move, which also allows the ripple to flatten out. That is, the curved edge places pressure on different linear regions of the media sheet at different times to more easily allow bubbles or ripples to be smoothed out and eliminated. To the contrary, a linear, non-curved transfer assist blade edge applies pressure to all adjacent linear regions of the media sheet simultaneously, which binds the media sheet unnecessarily and limits the ability to smooth out bubbles or ripples.

In one embodiment shown in FIG. 1, the transfer assist blade assembly 200 comprises a base 153 and the transfer assist blade 155 is operatively connected to the base 153. In the embodiment shown in FIG. 1, the transfer assist blade 155 can be attached to the base 153 or can be formed as a continuous integral part of the base 153, such that the base 153 and transfer assist blade 155 make up a single unitary structure.

Figure 2:
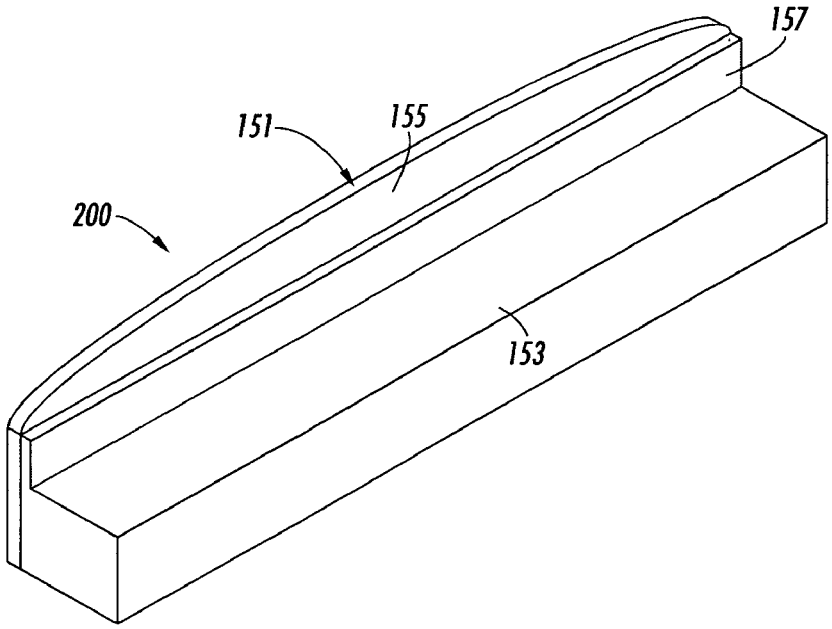
FIG. 2 is a schematic diagram of a curved transfer assist blade.

In one alternative embodiment shown in FIG. 2, the transfer assist blade 155 can be attached to a conventional linear (non-curved) transfer assist blade or other similar protrusion 157 as an additional layer of blade material. The blade material 155 can be the same material as the base 153, or can be a different material, which can comprise any of the blade materials discussed in U.S. Patent Application 2003/0039488 (the complete disclosure of which is incorporated herein by reference) such as plastics, UHMW Polyethylene, Polyester films (Melinex or Mylar) ceramics, metals, alloys, rubbers, etc. are materials currently being used today.

Thus, in the embodiment shown in FIG. 2, the curved transfer assist blade 155 can comprise a part of a conversion kit that can be used to convert a linear transfer assist blade assembly into a curved transfer assist blade assembly. When adding a curved transfer assist blade to an existing system that previously had a linear, non-curved transfer assist blade, some timing (engagement/disengagement) NVM parameters should be changed to account for the extended blade, and the transfer assist blade stepper motor engagement steps NVM and motor profile NVM parameters should be correspondingly adjusted.

Figure 3:
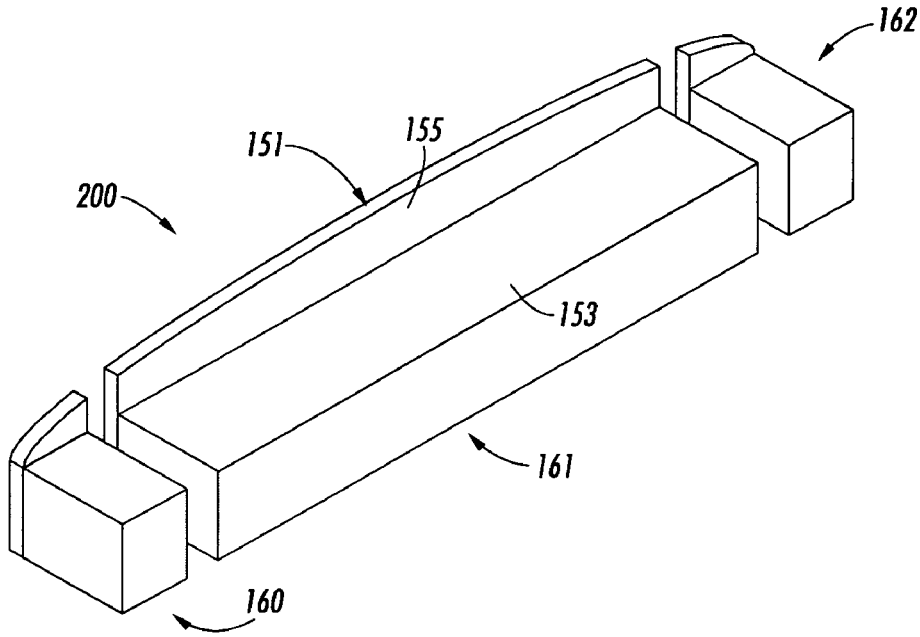
FIG. 3 is a schematic diagram of a segmented curved transfer assist blade.
Figure 4:
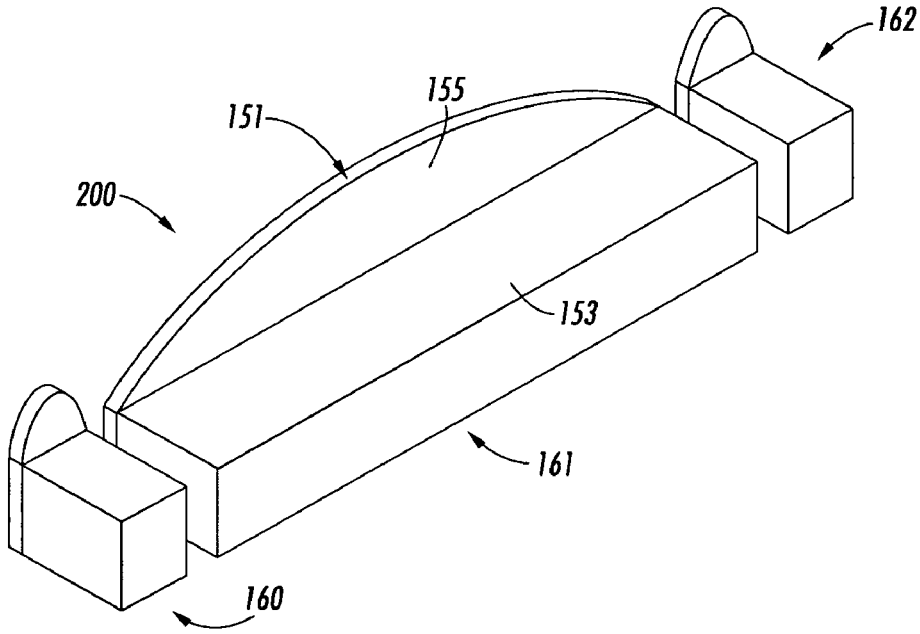
FIG. 4 is a schematic diagram of a curved transfer assist blade.

All embodiments herein are equally applicable to segmented and non-segmented transfer assist blades. Thus, as illustrated in FIG. 3, the curved transfer assist blade 155 and base can comprise segments 160-162, as discussed above. The centerline of the curved shape could be centered about the full process width, as shown in FIG. 3 or the centerline of the curved shape can be centered above each segment, as shown in FIG. 4. As shown in non-perspective view in FIG. 5, the curved media contact edge 151 of the transfer assist blade 155 comprises a center portion 169 and end portions 167 distal to the center portion 169. The center portion 169 extends a different distance from the base 153 (distance 165) than the end portions 167 (distance 163) extend from the base 153. Thus, the shape of the media contact edge 151 can comprise a convex shape.

Figure 5:
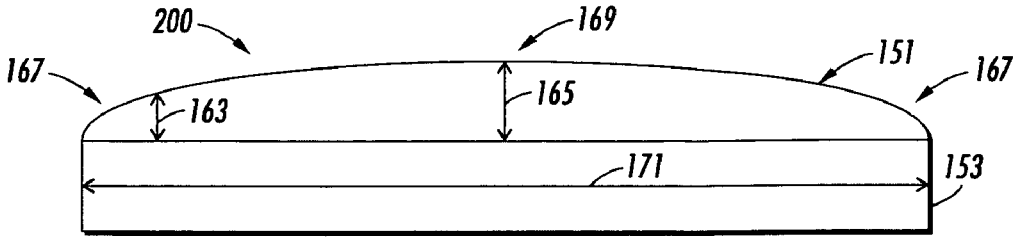
FIG. 5 is a schematic diagram of a curved transfer assist blade.

In the convex shape embodiment shown in FIG. 5, the media contact edge 151 has a curve height 165 above the base 153 and the media contact edge 151 has a media contact edge length 171. The ratio of the media contact edge length 11 to the curve height 165 ranges from 9:10 to 25:1, can be 2:1 to 10:1, and can be, for example, 4:1 to 4.3. Thus, in one example, the ratio of the media contact length to the curve height can be 6:1.

Figure 6:
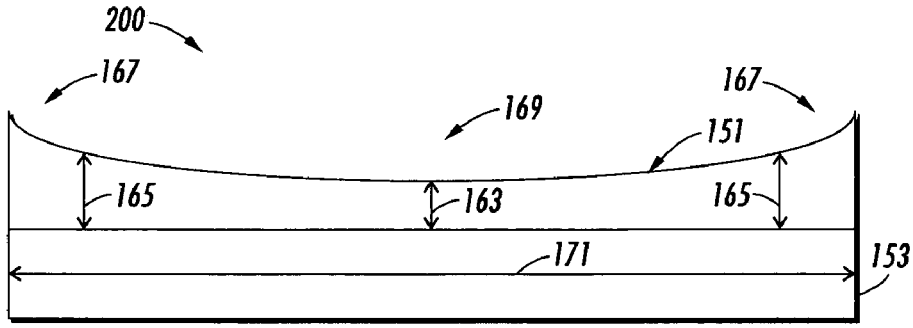
FIG. 6 is a schematic diagram of a curved transfer assist blade.

While the foregoing embodiments discuss convex shaped transfer assist blades, other embodiments herein use different shaped blades. For example, the embodiment shown in FIG. 6 utilizes a concave shaped transfer assist blade 155 where the center section 169 has the lower height 163 when compared to the larger heights 165 of the outer portions 167 of the curved edge 151. The concave shape embodiment could have similar ratios to those mentioned above with respect to the convex shape embodiment.

Figure 7:
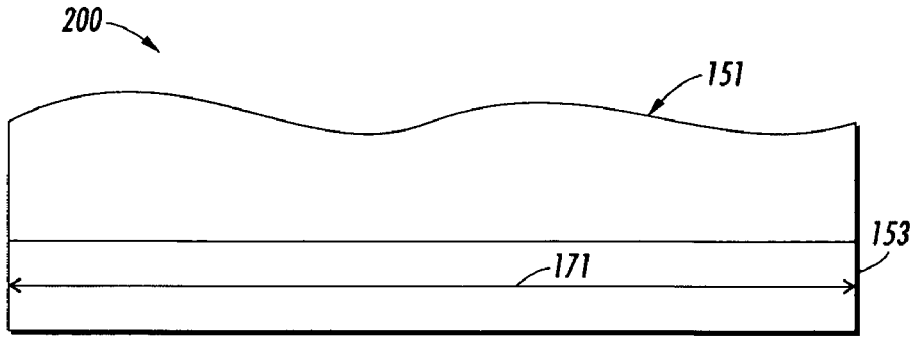
FIG. 7 is a schematic diagram of a curved transfer assist blade.
Figure 8:
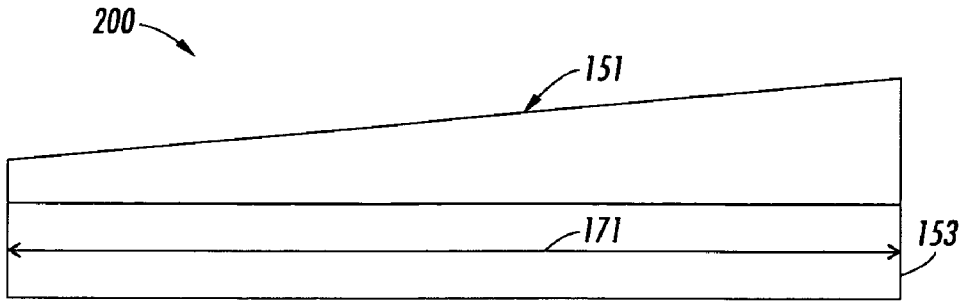
FIG. 8 is a schematic diagram of an angled transfer assist blade.

Additional embodiments include transfer assist blades having different shapes such as the irregular curved shape illustrated in FIG. 7 or the angled linear shape illustrated in FIG. 8. While FIG. 8 illustrates a linear edge 151, the edge 151 is angled with respect to the base 153. Thus, the angled linear edge 151 shown in FIG. 8 will be other than parallel or perpendicular to the top/bottom and sides of the media sheet as the media sheet passes by the transfer assist blade assembly 200. The angled linear edge acts as a plow to push the bubbles or ripples from one side of the sheet to the other side of the sheet, in a similar manner to the curved transfer assist blades that are discussed above. While many different shapes are utilized in the different embodiments discussed herein, the foregoing are only examples, and any similarly shaped blade can be used with embodiments herein. One common feature of all embodiments is that, as the media sheet moves past the transfer assist blade, the edge applies pressure to the media sheet at different linear locations along the length (from top to bottom, or bottom to top) of the media sheet. This prevents adjacent linear regions from receiving simultaneous pressure from the edge of the transfer assist blade, which keeps such adjacent linear regions from binding and allows ripples or bubbles to be more easily removed. To the contrary, linear transfer assist blades that are positioned to contact the media sheet in a position that is parallel or perpendicular to the sides and top/bottom of the media sheet, tend to bind adjacent linear portions of the media sheet, which inhibits elimination of the ripples and/or bubbles.

One ordinarily skilled in the art would understand that the shape of the media contact edge 151 can be adjusted to meet any specific design needs and that the specific shapes discussed herein do not limit the shape of the media contact edge defined by the claims below. The shape can be chosen to create a force vectoring profile that will squeeze the ripple out from the center to the edges or from edge-to-edge. The blade can be continuous, for a single paper width, or segmented, for multiple paper widths.

A printing apparatus embodiment comprises a marking device 11 and the aforementioned transfer assist blade 200 positioned adjacent the marking device 11. For example, the marking device can comprise an electrostatographic device, xerographic device, etc. Further, the word "printer" as used herein encompasses any apparatus, such as a digital copier, bookmaking machine, facsimile machine, multi-function machine, etc. which performs a print outputting function for any purpose. The following claims can encompass embodiments that print in monochrome, color, or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. A transfer assist blade adapted to bias media toward a marking device, said transfer assist blade comprising:

a flexible media contact edge positioned adjacent said marking device, wherein a shape of said media contact edge consists of a continuous, non-segmented convex curved shape, wherein said convex curved shape extends a full length of said transfer assist blade.

2. The transfer assist blade according to claim 1, wherein said media contact edge comprises portions that are positioned other than parallel or perpendicular to edges of media sheets as said media sheets pass between said marking device and said media contact edge.

3. A transfer assist blade assembly adapted to bias media toward a marking device, said transfer assist blade assembly comprising:

a base; and a transfer assist blade operatively connected to said base, wherein said transfer assist blade comprises a flexible media contact edge operatively positioned adjacent said marking device, wherein a shape of said media contact edge consists of a continuous, non-segmented convex curved shape, wherein said convex curved shape extends a full length of said transfer assist blade, wherein said media contact edge comprises a center portion and end portions distal to said center portion, and wherein said center portion extends a different distance from said base than said end portions extend from said base.

4. The transfer assist blade assembly according to claim 3, wherein said transfer assist blade comprises an integral part of said base.

5. The transfer assist blade assembly according to claim 3, wherein said media contact edge comprises portions that are positioned other than parallel or perpendicular to edges of media sheets as said media sheets pass between said marking device and said media contact edge.

6. A transfer assist blade adapted to bias media toward a marking device, said transfer assist blade comprising:

a flexible media contact edge positioned adjacent said marking device, wherein a shape of said media contact edge consists of a continuous, non-segmented convex curved shape that applies pressure to a media sheet that passes between said marking device and said media contact edge at different linear locations along a length of said media sheet, wherein said convex curved shape extends a full length of said transfer assist blade.

7. The transfer assist blade according to claim 6, wherein said media contact edge comprises portions that are positioned other than parallel or perpendicular to edges of media sheets as said media sheets pass between said marking device and said media contact edge.

8. A printing apparatus comprising:

a marking device;

a transfer assist blade adjacent said marking device, wherein said transfer assist blade comprises:

a flexible media contact edge positioned adjacent said marking device, wherein a shape of said media contact edge consists of a continuous, non-segmented convex curved shape, wherein said convex curved shape extends a full length of said transfer assist blade.

9. The printing apparatus according to claim 8, wherein said media contact edge comprises portions that are positioned other than parallel or perpendicular to edges of media sheets as said media sheets pass between said marking device and said media contact edge.

10. The printing apparatus according to claim 8, wherein said marking device comprises one of an electrostatographic device and a xerographic device.

* * * * *